US010852052B2

(12) United States Patent
Liang et al.

(10) Patent No.: US 10,852,052 B2
(45) Date of Patent: Dec. 1, 2020

(54) REFRIGERATING DEVICE

(71) Applicants: HEFEI HUALING CO., LTD., Hefei (CN); MIDEA GROUP CO., LTD., Foshan (CN)

(72) Inventors: Benlei Liang, Hefei (CN); Pingfang Li, Hefei (CN); Chao Liu, Hefei (CN)

( * ) Notice: Subject to any disclaimer, the term of this patent is extended or adjusted under 35 U.S.C. 154(b) by 130 days.

(21) Appl. No.: 15/762,550

(22) PCT Filed: May 30, 2016

(86) PCT No.: PCT/CN2016/083949
§ 371 (c)(1),
(2) Date: Mar. 22, 2018

(87) PCT Pub. No.: WO2017/206028
PCT Pub. Date: Dec. 7, 2017

(65) Prior Publication Data
US 2020/0240699 A1 Jul. 30, 2020

(51) Int. Cl.
*F25D 21/04* (2006.01)
*F25D 11/00* (2006.01)
(Continued)

(52) U.S. Cl.
CPC ..... *F25D 21/04* (2013.01); *F25D 11/00* (2013.01); *F25B 2700/02* (2013.01);
(Continued)

(58) Field of Classification Search
CPC ..... F25D 21/04; F25D 11/00; F25D 2700/02; F25D 2317/0411; F25D 17/042; F25D 23/02; F24F 3/14
See application file for complete search history.

(56) References Cited

U.S. PATENT DOCUMENTS

2008/0161268 A1* 7/2008 Yen ..... C07F 7/1804 514/63
2012/0159804 A1* 6/2012 Sauerbeck ..... A47L 15/481 34/353

FOREIGN PATENT DOCUMENTS

CN 101784851 A 7/2010
CN 20182810 U 5/2011
(Continued)

OTHER PUBLICATIONS

The fourth Office Action dated Jul. 11, 2019 in corresponding CN application201610389307.4.
(Continued)

*Primary Examiner* — Emmanuel E Duke
(74) *Attorney, Agent, or Firm* — Kilpatrick Townsend & Stockton, LLP

(57) ABSTRACT

A refrigerating device includes a cabinet, a condenser and a dehumidifying device. The cabinet defines a compartment therein and includes a rear panel, and an inner wall of the compartment defines an air permeable hole. The condenser is disposed to the rear panel. The dehumidifying device includes a casing and a dehumidifying assembly disposed in the casing, the casing is disposed to the rear panel and located outside the cabinet, the casing defines a first air through hole and a second air through hole in communication with the casing respectively, the first air through hole is communicated with the air permeable hole through an air communication assembly, and the second air through hole is communicated with an external environment.

8 Claims, 15 Drawing Sheets

(51) Int. Cl.
*F25D 17/04* (2006.01)
*F25D 23/02* (2006.01)

(52) U.S. Cl.
CPC ..... *F25D 17/042* (2013.01); *F25D 23/02* (2013.01); *F25D 2317/0411* (2013.01)

(56) References Cited

FOREIGN PATENT DOCUMENTS

| | | | | | |
|---|---|---|---|---|---|
| CN | 202869117 | U | | 4/2013 | |
| CN | 103673468 | A | * | 3/2014 | ..... F25D 21/04 |
| CN | 103673468 | A | | 3/2014 | |
| CN | 104289201 | A | * | 1/2015 | |
| CN | 104864656 | A | | 8/2015 | |
| CN | 104949435 | A | | 9/2015 | |
| CN | 103673468 | A | | 3/2016 | |
| DE | 20316568 | U1 | * | 2/2004 | ..... F25D 23/006 |
| DE | 20316568 | U1 | * | 3/2004 | |

OTHER PUBLICATIONS

CN First Office Action dated Feb. 27, 2018 in the corresponding Chinese application(application No. 201610389307.4).
European Office Action dated Jan. 22, 2019 in the corresponding EP application (application No. 16903416.2).
The third Office Action dated Apr. 28, 2019 in the corresponding CN application No.201610389307.4.

* cited by examiner

D-D

E-E

REFRIGERATING DEVICE

CROSS-REFERENCE TO RELATED APPLICATION

This application is a national phase entry under 35 USC § 371 of International Application PCT/CN2016/083949, filed May 30, 2016, the entire contents of which are incorporated herein by reference.

FIELD

The present disclosure relates to a field of electric appliance technology, more particularly to a refrigerating device.

BACKGROUND

In the related art, since a refrigeration device, such as a refrigerator, a freezer or the like, employs a coil evaporator, moisture carried by food or the like placed in the refrigerating device will disperse to an inner wall of the refrigerating device and will be frosted. In addition, an uneven door sealing strip of the refrigerating device and unbalanced air pressures inside and outside the refrigerating device will also cause frosting at an opening frame of the refrigerating device. The frosting problem inside the refrigerating device perplexes a user all the time, and some solutions have been proposed by many manufacturers at present, for example, adding a heater strip, performing defrosting regularly, employing a cooling mode of air cooling, etc., which increase energy consumption of the refrigerating device but have limited effect and unsatisfactory results.

SUMMARY

The present disclosure seeks to solve at least one of the problems existing in the related art. For this reason, the present disclosure provides a refrigerating device, which has a good frost resisting effect.

The refrigerating device according to the present disclosure includes: a cabinet defining a compartment and including a rear panel, an inner wall of the compartment defining an air permeable hole; a condenser disposed to the rear panel; a dehumidifying device configured to remove moisture in air and including a casing and a dehumidifying assembly disposed in the casing, the casing being disposed to the rear panel and located outside the cabinet, the casing defining a first air through hole and a second air through hole in communication with the casing respectively, the first air through hole being communicated with the air permeable hole via an air communication assembly, and the second air through hole being communicated with an external environment.

In the refrigerating device according to the present disclosure, by providing the dehumidifying device outside the rear panel of the refrigerating device, the dehumidifying device is made to be in direct contact with the air, such that the moisture in the air entering the refrigerating device can be absorbed by the dehumidifying assembly in the dehumidifying device, effectively avoiding causing condensation and even ice blockage, and heat produced by the condenser can vaporize the moisture in the dehumidifying assembly into the air, thereby improving a dehumidifying effect of the dehumidifying assembly and prolonging a service life of the dehumidifying assembly. Additionally, a size of a component of the dehumidifying device pre-buried inside the refrigerating device is reduced, and influence on energy consumption of the refrigerating device is decreased.

Furthermore, the refrigerating device according to embodiments of the present disclosure may further have the following additional technical features.

According to some embodiments of the present disclosure, the air communication assembly includes a first ventilation box disposed to the rear panel and located in the cabinet, the first ventilation box being communicated with the first air through hole; a second ventilation box disposed to a side wall of the compartment and being communicated with the air permeable hole; and a communicating pipe connected to the first ventilation box and the second ventilation box separately to communicate the first ventilation box and the second ventilation box.

Further, the air communication assembly further includes a water-blocking and air-permeable membrane configured to prevent a liquid from flowing to the air permeable hole.

In one embodiment, the water-blocking and air-permeable membrane is disposed at a junction of the first ventilation box and the communicating pipe.

In one embodiment, the second ventilation box includes an air permeable box disposed to an outer peripheral wall of the compartment; and an air permeable cover, a part of the air permeable cover extending into the air permeable box through the air permeable hole, and another part of the air permeable cover abutting against an inner peripheral wall of the compartment.

According to some embodiments of the present disclosure, the casing of the dehumidifying device is fixedly connected to the first ventilation box.

In one embodiment, the casing includes a body defining an accommodating space for the dehumidifying assembly; and a cover fixed to the body and disposed to the rear panel, the first air through hole being defined in the cover, and the second air through hole being defined in the body.

In one embodiment, the communicating pipe is a flexible pipe.

In one embodiment, the dehumidifying assembly is a molecular sieve filled in the casing.

In one embodiment, the casing is detachably disposed to the rear panel.

BRIEF DESCRIPTION OF THE DRAWINGS

These and other aspects and advantages of embodiments of the present disclosure will become apparent and more readily appreciated from the following descriptions made with reference to the drawings, in which.

Figure 1:
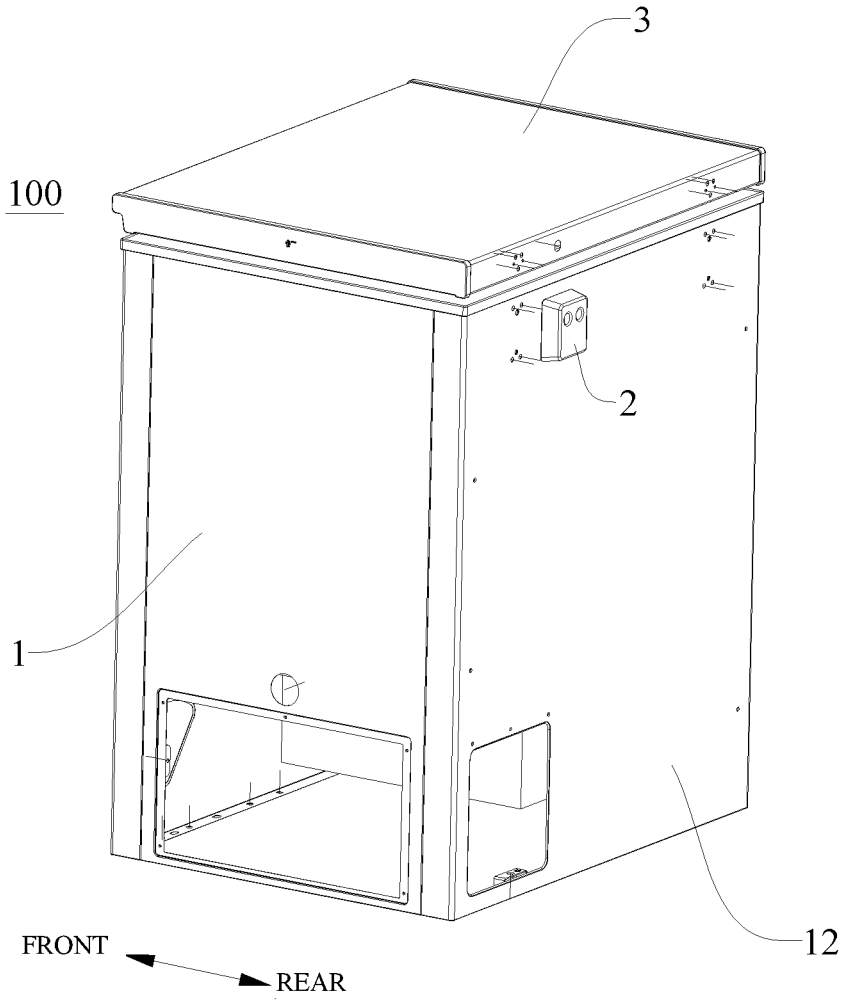
FIG. 1 is a perspective view of a refrigerating device according to an embodiment of the present disclosure.

REFERENCE NUMERALS refrigerating device 100, cabinet 1, compartment 11, air permeable hole 111, opening frame 112, rear panel 12, dehumidifying device 2, casing 21, body 211, second air through hole 2111, second snap 2112, first screw hole 2113, cover 212, first air through hole 2121, second snap groove 2122, second screw hole 2123, dehumidifying assembly 22, door 3, air communication assembly 4, first ventilation box 41, screw post 411, second ventilation box 42, air permeable box 421, first snap 4211, air permeable cover 422, first snap groove 4221, air hole 4222, communicating pipe 43, first end 431, second end 432, water-blocking and air-permeable membrane 44, condenser 5, screw 6.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, illustrative, and used to generally understand the present disclosure. The embodiments shall not be construed to limit the present disclosure.

In the specification, it is to be understood that terms such as "central," "upper," "lower," "front," "rear," "left," "right," "vertical," "horizontal," "top," "bottom," "inner," "outer," should be construed to refer to the orientation as then described or as shown in the drawings under discussion. These relative terms are for convenience of description and do not require that the present disclosure be constructed or operated in a particular orientation.

It should be noted that, terms such as "first" and "second" are used herein for purposes of description and are not intended to indicate or imply relative importance or significance or to imply the number of indicated technical features. Thus, features limited by "first" and "second" are intended to indicate or imply including one or more than one these features. Further, in the description of the present disclosure, "a plurality of" means two or more than two, unless specified otherwise.

A refrigerating device 100 according to embodiments of the present disclosure will be described in the following with reference to FIGS. 1 to 18. The refrigerating device 100 may be a refrigerator, a freezer or the like, but it is not limited thereto. In the following description of the present disclosure, the freezer is taken as an example to illustrate the refrigerating device 100.

Referring to FIGS. 1 to 4, the refrigerating device 100 according to embodiments of the present disclosure, such as the freezer, includes a cabinet 1, a condenser 5 and a dehumidifying device 2 configured to remove moisture in air.

In one embodiment, the cabinet 1 defines a compartment 11 therein, and an article to be refrigerated, such as food, beverage and so on, may be stored in the compartment 11. One compartment 11 may be provided, or a plurality of compartments 11 may also be provided. The specific number of the compartments 11 may be adjusted and designed based on a specification and model of the refrigerating device 100, which is not specifically limited by the present disclosure. Further, the refrigerating device 100 further includes a door 3, a side of the door 3 may be pivotally connected to the cabinet 1, for example, by a hinge or a pivoting shaft, and another side of the door 3 may cooperate to open the cabinet 1 such that a user can take the article from or place the article in the cabinet 1 conveniently.

Figure 2:
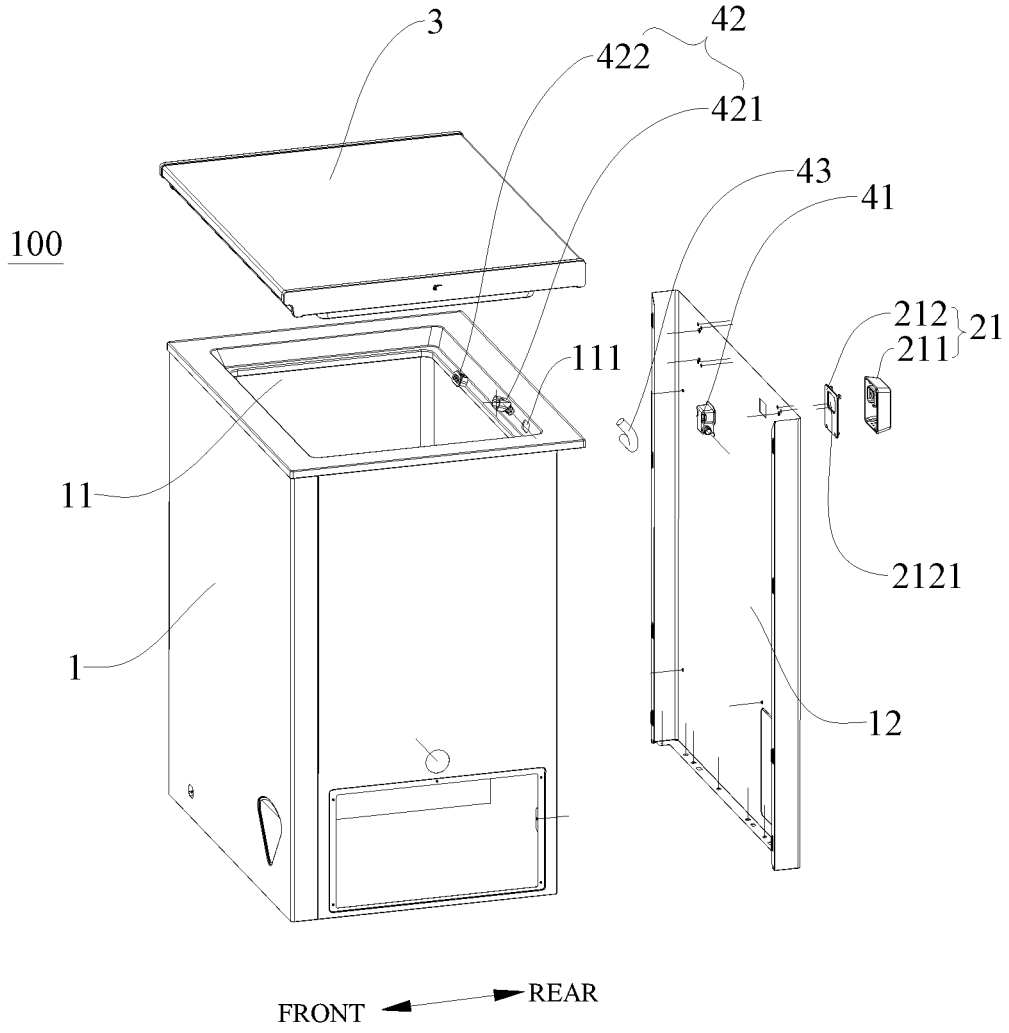
FIG. 2 is an exploded view of the refrigerating device shown in FIG. 1.
Figure 3:
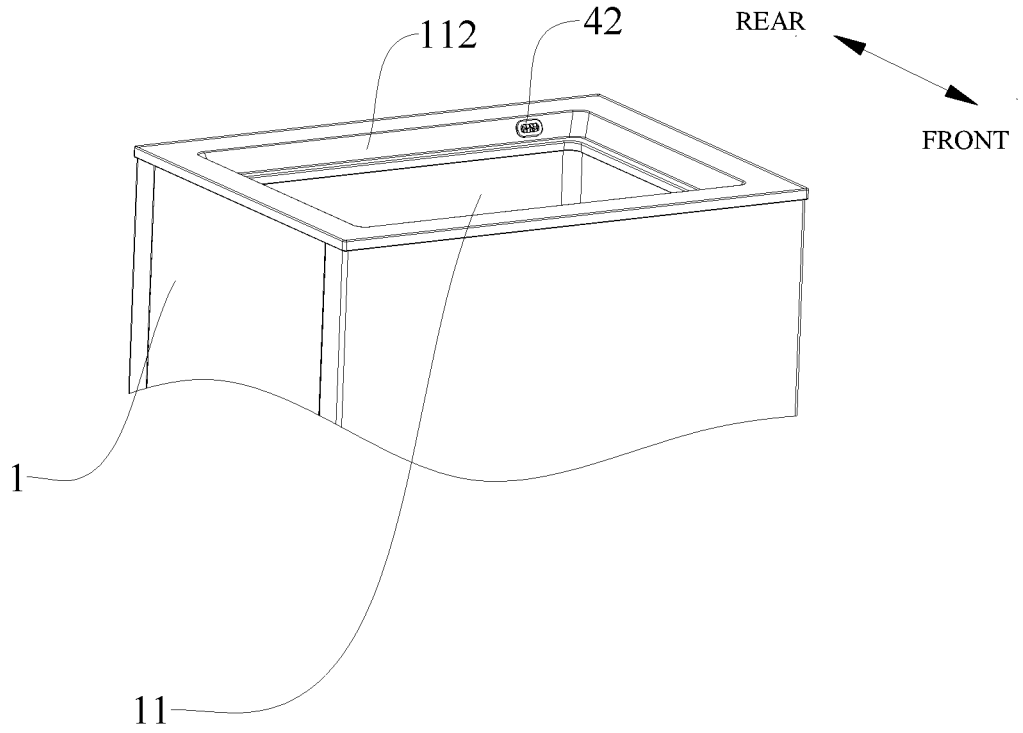
FIG. 3 is a perspective view of a cabinet of the refrigerating device shown in FIG. 1.
Figure 4:
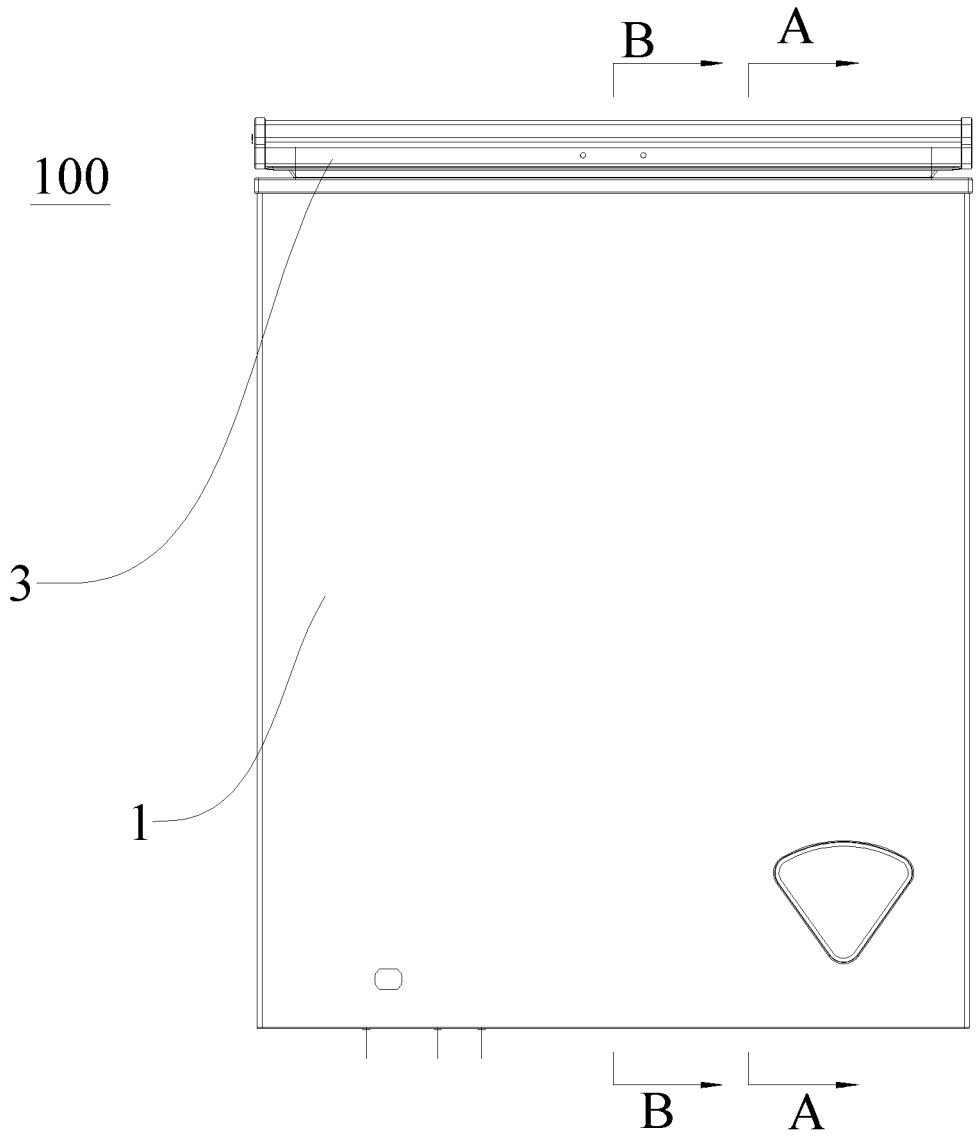
FIG. 4 is a left view of the refrigerating device shown in FIG. 1.
Figure 5:
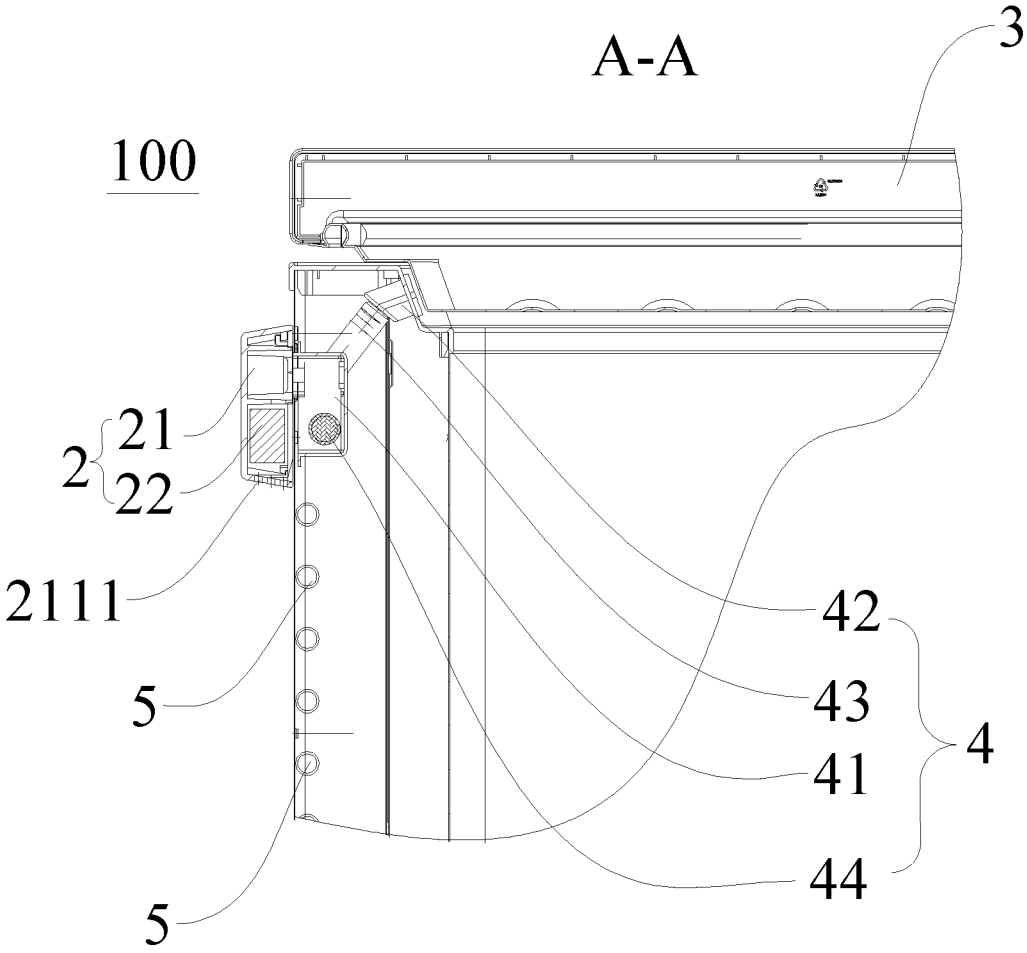
FIG. 5 is a sectional view taken along line A-A in FIG. 4.
Figure 6:
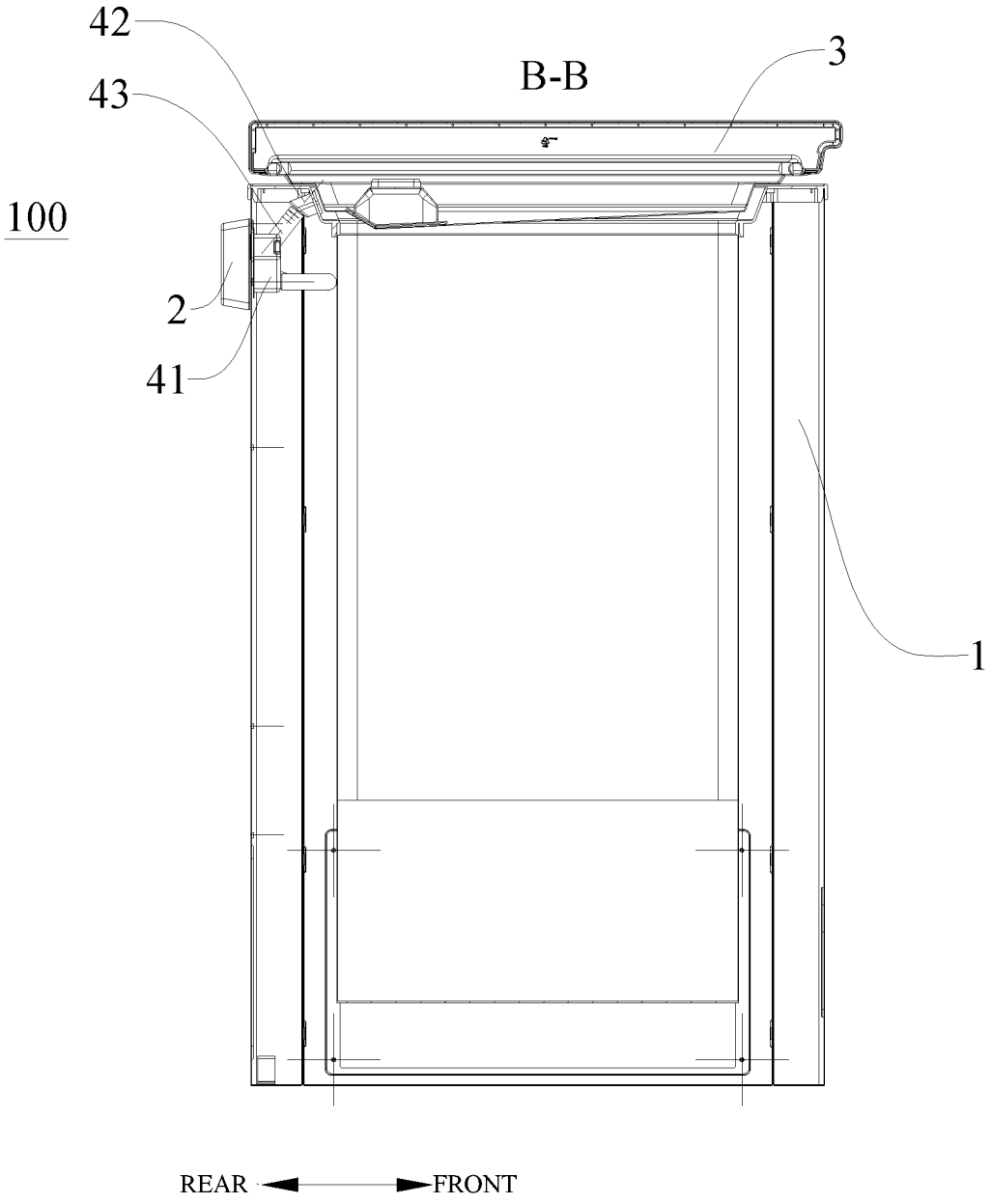
FIG. 6 is a sectional view taken along line B-B in FIG. 4.
Figure 7:
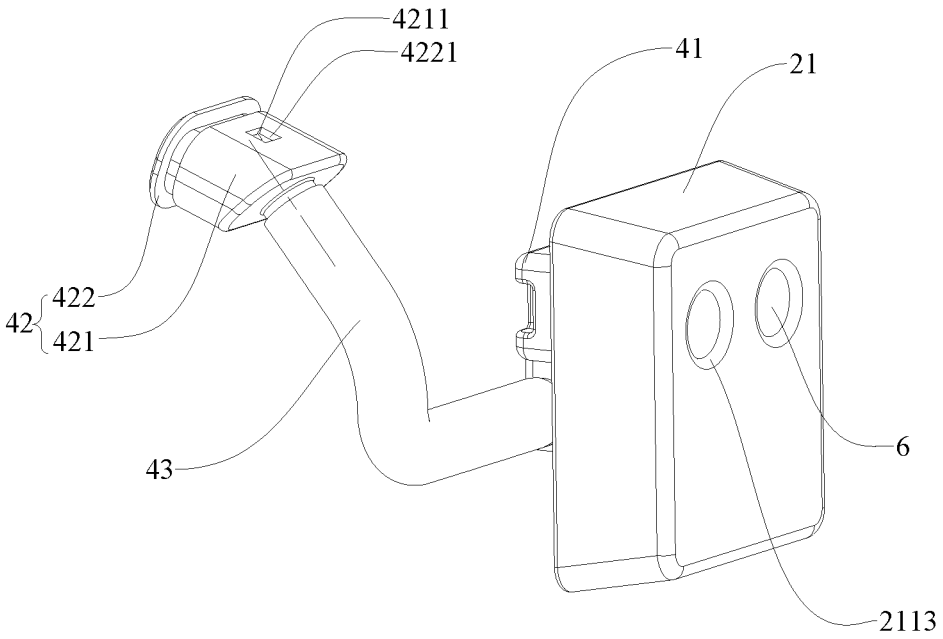
FIG. 7 is a perspective view of a dehumidifying device and an air communication assembly according to an embodiment of the present disclosure.
Figure 8:
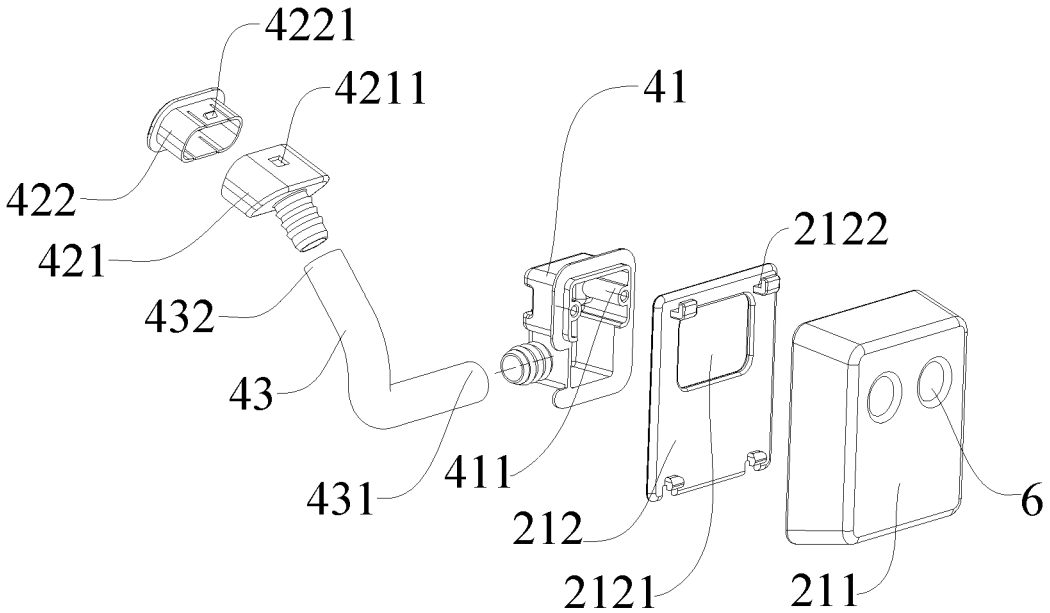
FIG. 8 is an exploded view of the dehumidifying device and the air communication assembly shown in FIG. 7.
Figure 9:
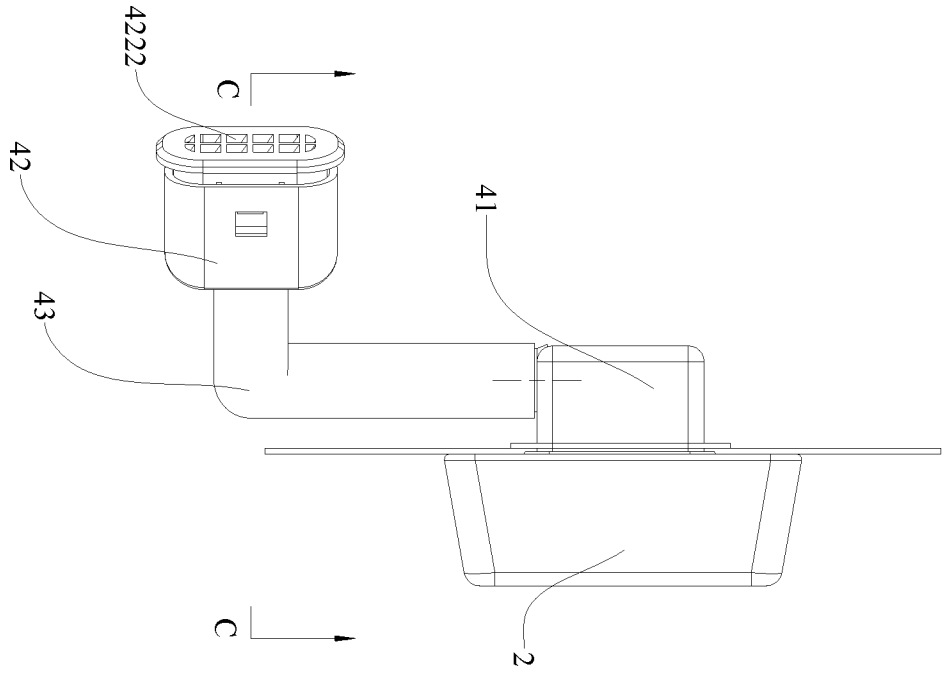
FIG. 9 is a schematic view of a dehumidifying device and an air communication assembly according to an embodiment of the present disclosure.
Figure 10:
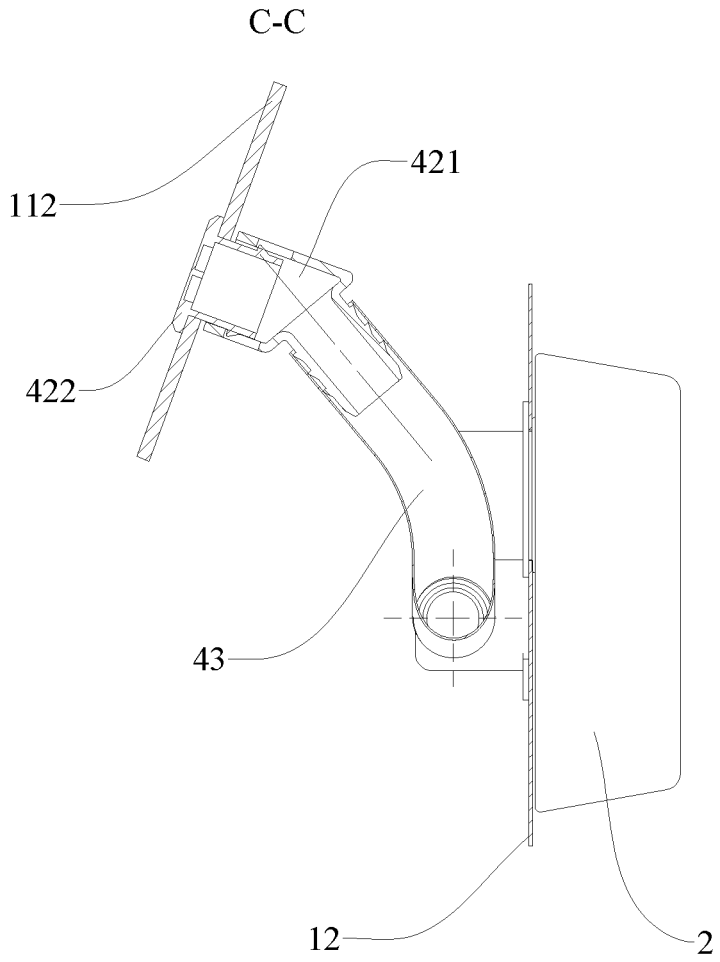
FIG. 10 is a sectional view taken along line C-C in FIG. 9.
Figure 11:
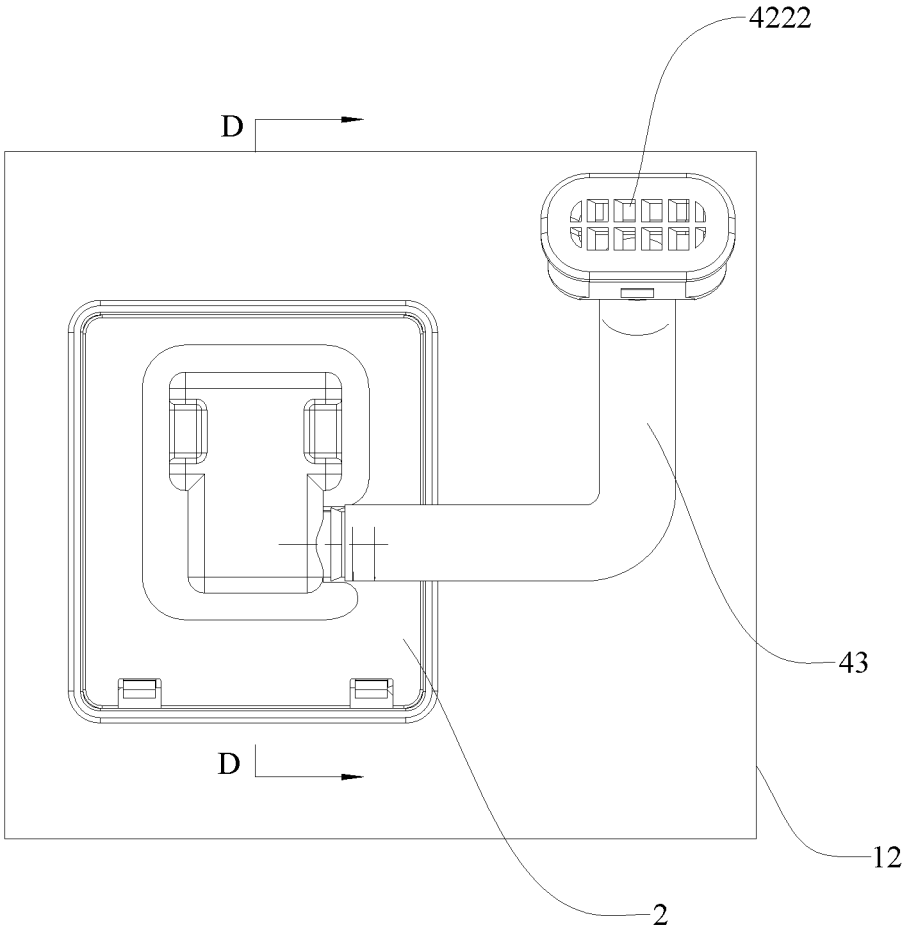
FIG. 11 is another schematic view of a dehumidifying device and an air communication assembly according to an embodiment of the present disclosure.
Figure 12:
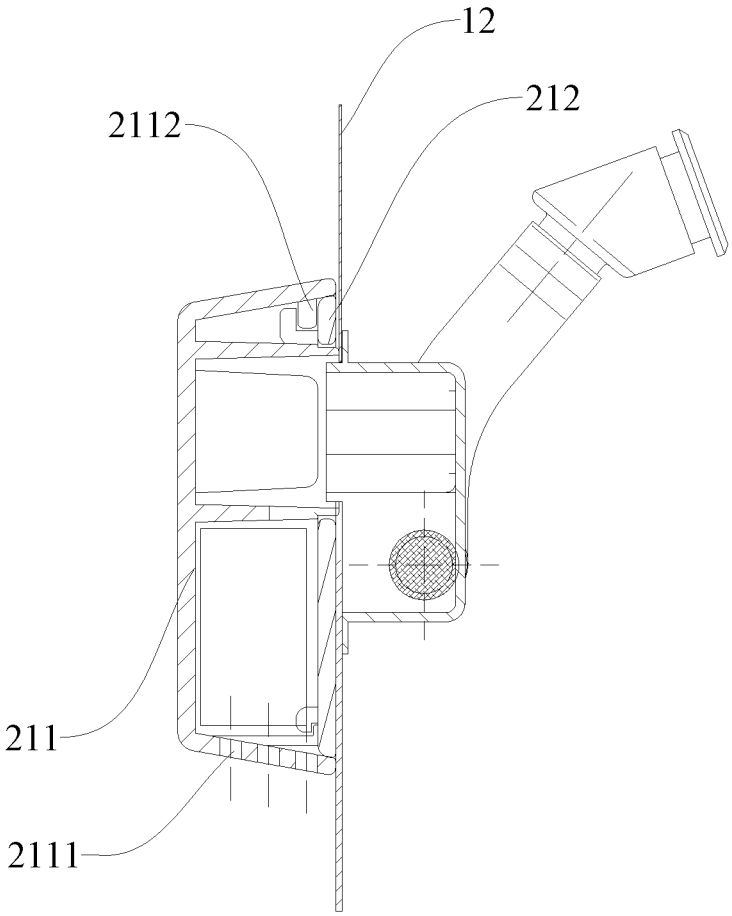
FIG. 12 is a sectional view taken along line D-D in FIG. 11.
Figure 13:
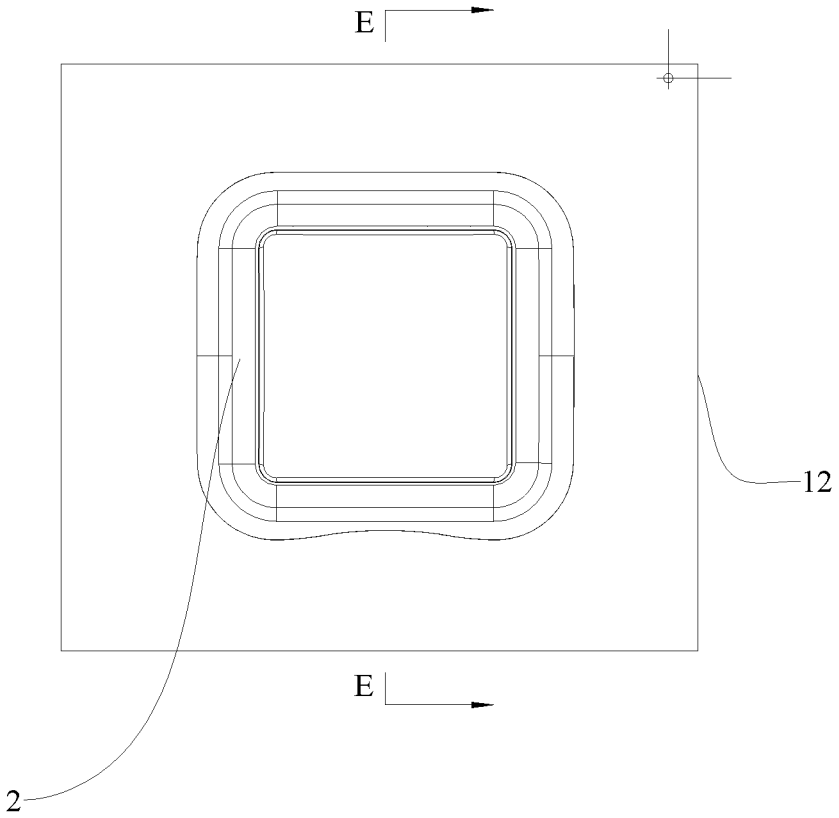
FIG. 13 is a schematic view of a dehumidifying device and an air communication assembly according to another embodiment of the present disclosure.

Referring to FIGS. 2 and 3, the cabinet 1 includes a rear panel 12, an inner wall of the compartment 11 defines an air permeable hole 111, and the condenser 5 is disposed to the rear panel 12. When a compressor of the refrigeration device 100 is in operation, all or part of heat produced by the condenser 5 can be dissipated through the rear panel 12. The condenser 5 may be a built-in condenser, and may also be an externally-hung condenser. That is to say, the condenser 5 may be disposed inside the rear panel 12, and may also be disposed outside the rear panel 12.

The dehumidifying device 2 includes a casing 21 and a dehumidifying assembly 22 disposed in the casing 21. The casing 21 of the dehumidifying device 2 is disposed to the rear panel 12 and located outside the cabinet 1, the casing 21 defines a first air through hole 2121 and a second air through hole 2111 in communication with the casing 21 respectively, the first air through hole 2121 is communicated with the air permeable hole 111 through an air communication assembly 4, and the second air through hole 2111 is communicated with an external environment. Therefore, the inside and the outside of the refrigerating device 100 can be communicated, air pressures inside and outside the refrigerating device 100 can be maintained balanced, and it is possible to effectively avoid generating a negative pressure inside the cabinet 1 after a long period of operation of the refrigerating device 100, thereby making it easy to open the cabinet 1 and facilitating use. In addition, the dehumidifying assembly 22 may absorb the moisture in the air, effectively prevent external air with higher humidity from entering the refrigerating device 100, and avoid ice blockage; meanwhile, when the refrigerating device 100 is in operation, the heat produced by the condenser 5 can be transferred to the dehumidifying device 2 through the rear panel 12, so as to disperse the moisture of the dehumidifying assembly 22 in the dehumidifying device 2, to improve a dehumidifying capacity of the dehumidifying assembly 22, and to prolong a replacement period of the dehumidifying assembly 22; furthermore, since the casing 21 of the dehumidifying device 2 is located outside the cabinet 1, space occupation inside the refrigerating device 100 is reduced, such that an influence on a thickness of a foaming layer is reduced, a requirement for a thickness of the cabinet 1 of the refrigerating device 100 is reduced, the refrigerating capacity of the refrigerating device 100 is improved, and an appearance of the refrigerating device 100 is promoted.

In the refrigerating device 100 according to embodiments of the present disclosure, by providing the dehumidifying device 2 outside the rear panel 12 of the refrigerating device 100, the dehumidifying device 2 is made to be in direct contact with the air, such that the moisture in the air entering the refrigerating device 100 can be absorbed by the dehumidifying assembly 22 in the dehumidifying device 2, effectively avoiding causing condensation and even the ice blockage, and the heat produced by the condenser 5 can vaporize the moisture in the dehumidifying assembly 22 into the air, thereby improving a dehumidifying effect of the dehumidifying assembly 22 and prolonging a service life of the dehumidifying assembly 22. Additionally, a size of a component of the dehumidifying device 2 pre-buried inside the refrigerating device 100 is reduced, and an influence on energy consumption of the refrigerating device 100 is decreased.

According to some embodiments of the present disclosure, referring to FIGS. 5 to 8, the air communication assembly 4 includes a first ventilation box 41, a second ventilation box 42 and a communicating pipe 43. The first ventilation box 41 is disposed to the rear panel 12 and located in the cabinet 1, the first ventilation box 41 is communicated with the first air through hole 2121, the second ventilation box 42 is disposed to a side wall of the compartment 11 and is communicated with the air permeable hole 111, and the communicating pipe 43 is connected to the first ventilation box 41 and the second ventilation box 42 separately to communicate the first ventilation box 41 and the second ventilation box 42. For example, a first end 431 of the communicating pipe 43 can be in threaded connection with the first ventilation box 41, and a second end 432 of the communicating pipe 43 can be in threaded connection with the second ventilation box 42. Thus, the inside and the outside of the refrigerating device 100 can be communicated, and the air pressures inside and outside the refrigerating device 100 can be maintained balanced, thereby making it easy to open the cabinet 1 of the refrigerating device 100 and facilitating the use of the refrigerating device 100.

Further, the air communication assembly 4 further includes a water-blocking and air-permeable membrane 44 configured to prevent a liquid from flowing to the air permeable hole 111. Thus, the moisture in the air entering the cabinet 1 is further reduced, and the water-blocking and air-permeable membrane 44 has a degerming effect, thereby preventing bacteria in the air from entering the refrigerating device 100 to contaminate the food, and guaranteeing safety of the food.

In one embodiment, the water-blocking and air-permeable membrane 44 may be disposed at a junction of the first ventilation box 41 and the communicating pipe 43. For example, referring to FIG. 5, the water-blocking and air-permeable membrane 44 may be attached to a hole at the junction of the first ventilation box 41 and the communicating pipe 43. Thus, when the water-blocking and air-permeable membrane 44 fails or the expiration date thereof is expired, replacement of the water-blocking and air-permeable membrane 44 can be performed conveniently.

Figure 14:
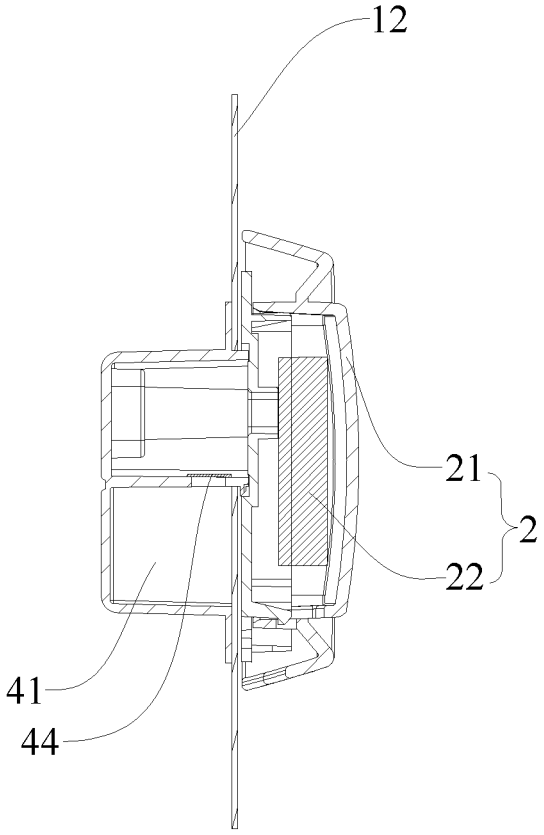
FIG. 14 is a sectional view taken along line E-E in FIG. 13.

Certainly, it should be understood that, the water-blocking and air-permeable membrane 44 may also be disposed in the first ventilation box 41 (as illustrated in FIG. 14), and thus, the moisture and the bacteria in the air entering the cabinet 1 can also be reduced.

In one embodiment, referring to FIGS. 7 to 12, the second ventilation box 42 includes an air permeable box 421 and an air permeable cover 422. The air permeable box 421 is disposed to an outer peripheral wall of the compartment 11, a part of the air permeable cover 422 extends into the air permeable box 421 through the air permeable hole 111, and another part of the air permeable cover 422 abuts against an inner peripheral wall of the compartment 11. The air permeable hole 111 may be defined in an inner container or in an opening frame 112 of the cabinet 1. For example, the air permeable hole 111 is preferably defined in the opening frame 112, and thus, the second ventilation box 42 can be fixed in the compartment 11 conveniently. That is to say, a part of the side wall of the compartment 11 surrounding the air permeable hole 111 is clamped between the air permeable box 421 and the air permeable cover 422, such that the second ventilation box 42 can be fixed to the compartment 11 by way of fitting between the air permeable cover 422 and the air permeable box 421, simplifying an assembling process.

According to some specific embodiments of the present disclosure, the air permeable cover 422 and the air permeable box 421 can be connected through a snap-fit. For example, referring to FIG. 8, the air permeable box 421 is provided with a first snap 4211, the air permeable cover 422 defines a first snap groove 4221 fitted with the first snap 4211, the first snap 4211 extends into the first snap 4211 to achieve a connection between the air permeable cover 422 and the air permeable box 421, and this structure is simple and easy to assemble and disassemble.

Figure 16:
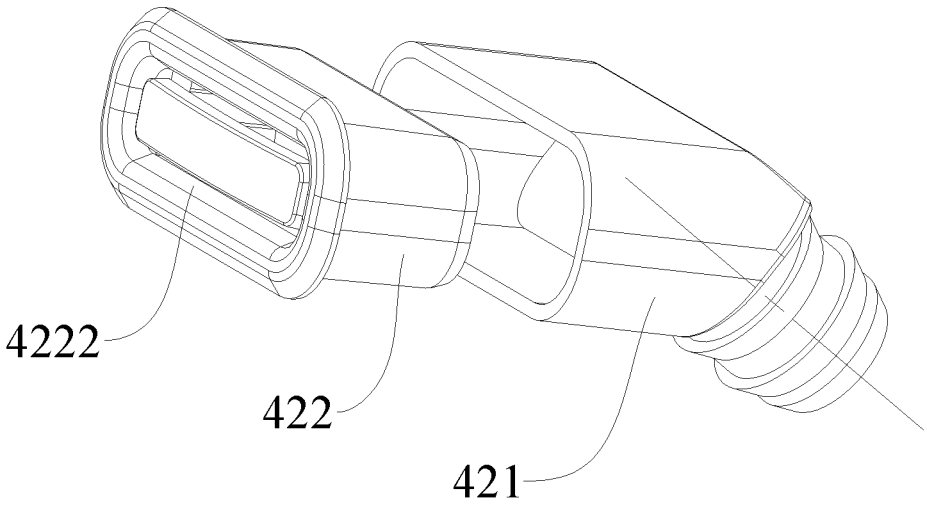
FIG. 16 is an exploded view of a second ventilation box shown in FIG. 13.
Figure 17:
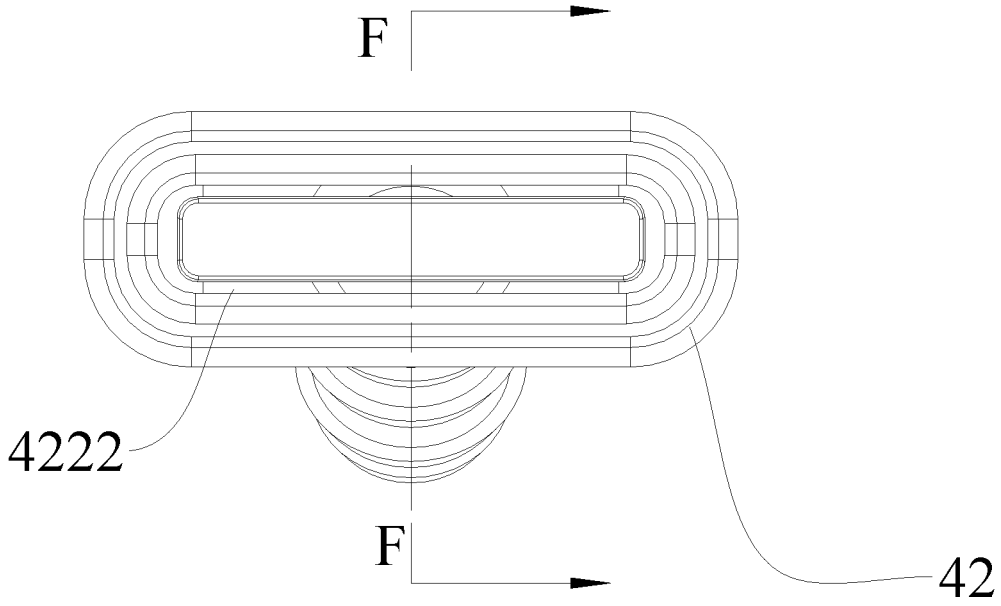
FIG. 17 is a front view of the second ventilation box shown in FIG. 16.
Figure 18:
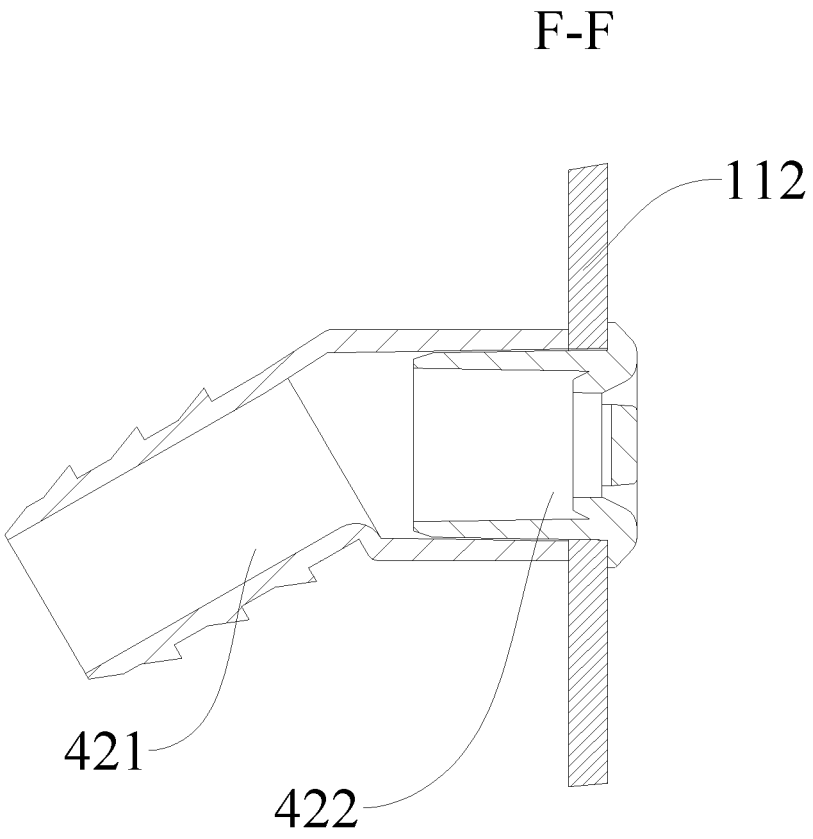
FIG. 18 is a sectional view taken along line F-F in FIG. 17.

According to some other embodiments of the present disclosure, referring to FIGS. 16 and 18, the air permeable cover 422 and the air permeable box 421 can be connected in an interference fit. Thus, an overall volume of the second ventilation box 42 can be reduced, and the space occupation of the second ventilation box 42 can be reduced, thereby reducing the requirement for the thickness of a mounting position, and reducing the assembly difficulty.

In one embodiment, an outer surface of the air permeable cover 422 may define an air hole 4222. For example, referring to FIGS. 9 and 11, the air hole 4222 may be provided in the outer surface of the air permeable cover 422. A plurality of air holes 4222 may be provided, and the plurality of air holes 4222 are arranged in an array, but it is not limited to this. For example, referring to FIGS. 16 to 18, one air hole 4222 may also be provided, and the air hole 4222 may be formed in a ring shape.

In one embodiment, referring to FIGS. 8 to 12, the casing 21 of the dehumidifying device 2 includes a body 211 and a cover 212, the body 211 internally defines an accommodating space for the dehumidifying assembly 22, the cover 212 is fixed to the body 211, the cover 212 is disposed to the rear panel 12, the first air through hole 2121 is defined in the cover 212, and the second air through hole 2111 is defined in the body 211. For example, referring to FIGS. 8 and 12 in combination with FIGS. 13 to 15, the first air through hole 2121 can be defined in a middle upper part of the cover 212, the first air through hole 2121 may be formed in a square or rectangular shape, a circular shape or the like, and the second air through hole 2111 may be defined in a bottom of the body 211, but it is not limited to this. For example, the second air through hole 2111 may also be defined in a top of the body 211. Preferably, the cover 212 and the body 211 are detachably connected, thereby facilitating the replacement of the dehumidifying assembly 22.

According to some embodiments of the present disclosure, the body 211 and the cover 212 can be connected through a snap-fit. For example, as an example in FIGS. 8 and 15, the body 211 may be provided with a second snap 2112, the cover 212 may define a second snap groove 2122 fitted with the second snap 2112, and a fitting between the second snap 2112 and the second snap groove 2122 can assemble the cover 212 and the body 211 together.

According to some embodiments of the present disclosure, the casing 21 of the dehumidifying device 2 is fixedly connected to the first ventilation box 41. The dehumidifying device 2 can be connected to the first ventilation box 41 by a snap or a screw 6, but it is not limited to this. For example, referring to FIGS. 8 and 15, the dehumidifying device 2 is connected to the first ventilation box 41 through the screw 6. In one embodiment, the first ventilation box 41 may be connected to the body 211 of the casing 21, and may also be connected to the cover 212 of the casing 21. For example, as an example in FIG. 8, the first ventilation box 41 is provided with a screw post 411, and the body 211 defines a first screw hole 2113. When assembled, the body 211 and the cover 212 can be first connected together, and then the screw 6 can be connected to the screw post 411 through the first screw hole 2113 to connect the body 211 and the first ventilation box 41 together, completing the assembly.

Figure 15:
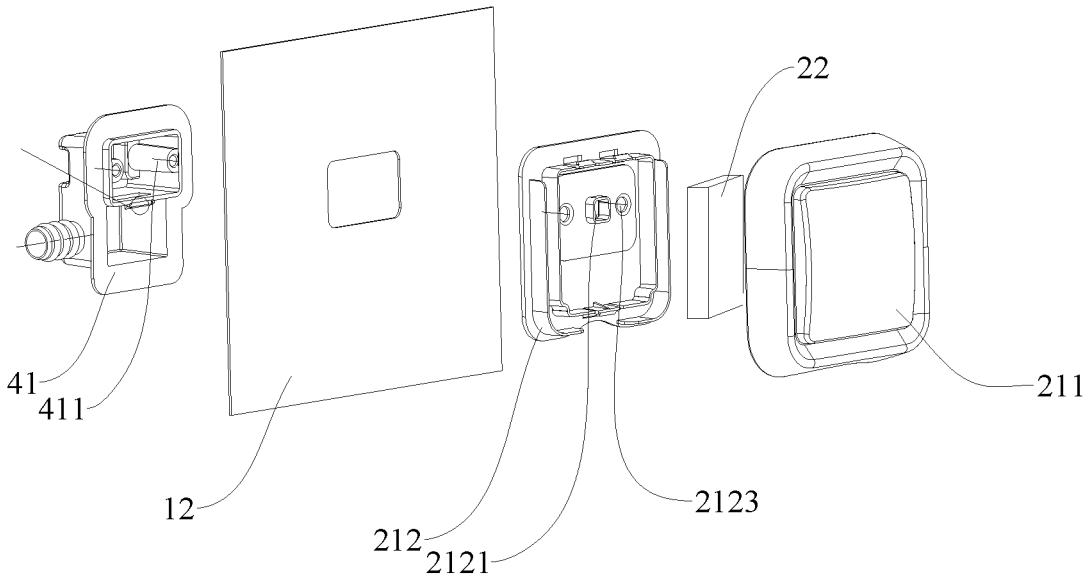
FIG. 15 is an exploded view of the dehumidifying device and a first ventilation box shown in FIG. 13.

For another example, as an example in FIG. 15, the first ventilation box 41 is provided with the screw post 411, and the cover 212 defines a second screw hole 2123. When assembled, the screw 6 can pass through the second screw hole 2123 firstly to connect the cover 212 and the first ventilation box 41 together, and the body 211 can be then connected to the cover 212, completing the assembly. Therefore, the structure is simple and easy to process and assemble.

In one embodiment, the communicating pipe 43 is a flexible pipe, but it is not limited to this. For example, the communicating pipe 43 may be a corrugated pipe, a metal flexible pipe or the like, as long as the communicating pipe 43 has a flexible swerving function and certain strength. Thus, the communicating pipe 43 is easy to assemble and can be prevented from being compressed by a foaming liquid, thereby keeping the communicating pipe 43 unobstructed, and keeping the inside and the outside of the refrigerating device 100 communicated.

According to some embodiments of the present disclosure, the dehumidifying assembly 22 may be a molecular sieve filled in the casing 21. In one embodiment, the molecular sieve may include a drying agent and a degerming agent. The drying agent can absorb the moisture in the air entering the dehumidifying assembly 22 from the outside of the refrigerating device 100, and the degerming agent can prevent the bacteria in the air from entering the refrigerating device 100 to contaminate the food or the like, thereby guaranteeing the safety of the food.

According to some embodiments of the present disclosure, the casing 21 is detachably disposed to the rear panel 12. Thus, the dehumidifying assembly 22 in the casing 21 can be replaced conveniently, thereby ensuring the dehumidifying capacity of the dehumidifying device 2. For example, the casing 21 can be removed to replace the dehumidifying assembly 22 depending on changes in the humidity of the environment or when the expiration date of the molecular sieve is expired (the expiration date of the molecular sieve is generally 2 to 3 years), thereby ensuring the dehumidifying capacity of the dehumidifying device 2.

In the refrigerating device 100 according to embodiments of the present disclosure, the moisture in the air entering the refrigerating device 100 can be absorbed by the dehumidifying assembly 22 in the dehumidifying device 2, effectively avoiding causing the condensation and even the ice blockage, and the heat produced by the condenser 5 can vaporize the moisture in the dehumidifying assembly 22 into the air, thereby improving the dehumidifying effect of the dehumidifying assembly 22 and prolonging the service life of the dehumidifying assembly 22. Additionally, the size of the component of the dehumidifying device 2 pre-buried inside the refrigerating device 100 is reduced, and the influence on energy consumption of the refrigerating device 100 is decreased.

Reference throughout this specification to "an embodiment," "some embodiments," "an illustrative embodiment," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and illustrated, and various changes, modifications, alternatives and variants without departing from the principle of the present disclosure are acceptable. The scope of the present disclosure is defined by the claims or the like.

What is claimed is:

1. A refrigerating device, comprising:

a cabinet defining a compartment and comprising a rear panel, an inner wall of the compartment defining an air permeable hole;

a condenser disposed to the rear panel; and a dehumidifying device configured to remove moisture in air, and comprising a casing and a dehumidifying assembly disposed in the casing, the casing being removably disposed to the rear panel and located outside the cabinet, the casing defining a first air through hole and a second air through hole in communication with the casing respectively, the first air through hole being communicated with the air permeable hole via an air communication assembly, and the second air through hole being communicated with an external environment;

wherein the dehumidifying assembly is a molecular sieve filled in the casing, the molecular sieve comprises at least a drying agent and a degerming agent;

wherein the air communication assembly comprises:

a first ventilation box disposed to the rear panel and located inside the cabinet, the first ventilation box being communicated with the first air through hole;

a second ventilation box located inside the cabinet, disposed to a side wall of the compartment and being communicated with the air permeable hole; and a communicating pipe connected to the first ventilation box and the second ventilation box separately to communicate the first ventilation box and the second ventilation box.

2. The refrigerating device according to claim 1, wherein the air communication assembly further comprises a water-blocking and air-permeable membrane configured to prevent a liquid from flowing to the air permeable hole.

3. The refrigerating device according to claim 2, wherein the water-blocking and air-permeable membrane is disposed at a junction of the first ventilation box and the communicating pipe.

4. The refrigerating device according to claim 2, wherein the water-blocking and air-permeable membrane is further configured to degerm air and prevent bacteria in the air from entering the refrigeration device.

5. The refrigerating device according to claim 1, wherein the second ventilation box comprises:

an air permeable box disposed to an outer peripheral wall of the compartment; and an air permeable cover, a part of the air permeable cover extending into the air permeable box through the air permeable hole, and another part of the air permeable cover abutting against an inner peripheral wall of the compartment.

6. The refrigerating device according to claim 1, wherein the casing of the dehumidifying device is fixedly connected to the first ventilation box.

7. The refrigerating device according to claim 1, wherein the casing comprises:

a body defining an accommodating space for the dehumidifying assembly; and a cover fixed to the body and disposed to the rear panel, the first air through hole being defined in the cover, and the second air through hole being defined in the body.

8. The refrigerating device according to claim 1, wherein the communicating pipe is a flexible pipe.

* * * * *